US005472793A

United States Patent [19]

Harada et al.

[11] Patent Number: 5,472,793

[45] Date of Patent: Dec. 5, 1995

[54] COMPOSITE SPRAY COATING HAVING IMPROVED RESISTANCE TO HOT-DIP GALVANIZATION

[75] Inventors: Yoshio Harada; Kazumi Tani; Yoshihumi Kobayashi, all of Hyogo, Japan

[73] Assignee: Tocalo Co., Ltd., Hyogo, Japan

[21] Appl. No.: 355,270

[22] Filed: Dec. 12, 1994

Related U.S. Application Data

[62] Division of Ser. No. 255,813, Jun. 7, 1994, Pat. No. 5,397,650, which is a continuation of Ser. No. 921,063, Jul. 29, 1992, abandoned.

[51] Int. Cl.[6] ..... B22F 7/04

[52] U.S. Cl. ..... 428/552; 428/546; 428/551; 428/553; 419/9; 419/10; 419/27

[58] Field of Search ..... 427/421, 422, 427/430.1, 431, 433, 475, 532, 564; 419/9, 10, 26, 27, 29; 428/552, 551, 546, 553

[56] References Cited

U.S. PATENT DOCUMENTS

| | | | |
|---|---|---|---|
| 4,912,835 | 4/1990 | Harada et al. | 29/132 |
| 5,035,957 | 7/1991 | Bartlett et al. | 428/552 |
| 5,070,587 | 12/1991 | Nakahira et al. | 29/132 |
| 5,073,415 | 12/1991 | Taylor et al. | 427/433 |
| 5,143,940 | 9/1992 | Pyzik et al. | 75/233 |
| 5,397,650 | 3/1995 | Harada et al. | 428/552 |

FOREIGN PATENT DOCUMENTS

| | | |
|---|---|---|
| 54-69529 | 6/1979 | Japan . |
| 58-25468 | 2/1983 | Japan . |
| 61-37955 | 2/1986 | Japan . |
| 61-117260 | 6/1986 | Japan . |
| 64-79356 | 3/1989 | Japan . |
| 1-225761 | 9/1989 | Japan . |
| 2-43352 | 2/1990 | Japan . |
| 2-236266 | 9/1990 | Japan . |
| 3-126854 | 5/1991 | Japan . |
| 3-63565 | 6/1991 | Japan . |
| 3-74654 | 7/1991 | Japan . |
| 3-285885 | 12/1991 | Japan . |
| 4-13857 | 1/1992 | Japan . |
| 4-13854 | 1/1992 | Japan . |
| 4-88159 | 3/1992 | Japan . |
| 4-116147 | 4/1992 | Japan . |

OTHER PUBLICATIONS

English Language Abstract of JP–61–37955.
English Language Abstract of JP–61–117260.
English Language of JP–58–25468.
English Language Claim of JP–3–63565.
English Language Claim of JP–3–74654.
English Language Abstract of JP–2–43352.
English Language Abstract of JP–2–236266.
English Langusge Abstract of JP–4–88159.
English Language Abstracts of Japanese Patents JP–54–69529, JP–1–225761, JP–1–79356, JP–3–126854, JP–3–285885, JP–4–13854, JP–4–13857 and JP–4–116147.
JIS H8303–1976, "Spray Fused Deposits of Self–Fluxing Alloys" Japanese Industrial Standard (1989 Edition) and English Language Translation.
JIS G3445–1983, "Carbon Steel Tubes for Machine Structural Purposes", Japanese Industrial Standard (1988 edition) and English Translation.

*Primary Examiner*—Donald P. Walsh
*Assistant Examiner*—John N. Greaves
*Attorney, Agent, or Firm*—Sandler, Greenblum & Bernstein

[57] ABSTRACT

A composite spray coating comprises an iron base material, a spray coating film applied thereon and a diffusion layer of aluminum or aluminum-zinc alloy, and is used for hot-dip galvanization.

16 Claims, 1 Drawing Sheet

COMPOSITE SPRAY COATING HAVING IMPROVED RESISTANCE TO HOT-DIP GALVANIZATION

This application is a division of application Ser. No. 08/255,813, filed Jun. 7, 1994, U.S. Pat. No. 5,397,650 which is a continuation of prior application Ser. No. 07/91,063, filed Jul. 29, 1992, now abandoned.

BACKGROUND OF THE INVENTION

1. Field of the Invention

This invention relates to composite spray coatings, and more particularly to a composite spray coating suitable for use in a sink roll and the like in a continuous hot-dip galvanization apparatus and having an excellent resistance to hot-dip galvanization.

The composite spray coating according to the invention is also useful as a member contacting molten zinc-aluminum alloy (bath-member) such as a cylinder, support roll, guide roll or the like for hot-dip zinc-aluminum alloy plating apparatus.

2. Description of the Related Art

This type of bath member is used by immersing in a hot-dip galvanization bath, or by arranging in a place which is liable to be adhered with scattered molten zinc, or in a place contacting with a high temperature galvanized steel sheet having hot dip adhered thereon.

Under such circumstances, the bath member is required to have the following properties:

(1) erosion due to hot-dip zinc hardly occurs;

(2) wearing hardly occurs even in the contacting with a passing sheet (steel sheet);

(3) peeling of adhered hot-dip zinc and maintenance and inspection are easy;

(4) service life as a roll is long and cost is low;

(5) it is durable to thermal shock when immersing in a high temperature hot-dip galvanization bath, and the like.

As roll or bearing constituting parts for the plating usually used, there are, for example, bush, bearing, collar and end ball and the like formed by (1) spray-coating Co base self-fluxing alloy defined according to JIS H8303 (1976), (2) spray-coating a ceramic of $ZrO_2$ and $Al_2O_3$ as disclosed in Japanese Patent Laid Open No. Publication 61-117260, (3) mainly spray-coating a coating consisting of at least one of WC, $Cr_3C_2$ and TiC and a hot corrosion-resistant metal of Ni, Si or the like or an oxide thereof and having a thickness of 0.1– 2.4 mm as disclosed in Japanese Patent Laid Open Publication No. 58-37386, (4) forming $Cr_2O_3$ onto a ceramic spray-coated coating mainly composed of a carbide by chemical densification process as disclosed in Japanese Utility Model Laid Open No. Publication 3-63565, and the like.

As seen from the above, there have been attempted (1) the improvement of coating material having excellent resistance to hot-dip galvanization, (2) the improvement of adhesion property of the coating, (3) the improvement of density of the coating, (4) the control of surface roughness of the coating and the like, whereby the coating formed on the surface of the bath members for the conventional hot dip galvanization have sufficiently improved.

However, it cannot be said that the above conventional techniques are satisfactorily responded to the requirement of developing the coatings having more improved resistance to hot-dip galvanization in accordance with the increase of operation ratio in the plating plant accomplished with the increase of recent demand of hot-dip galvanized steel sheets as well as the demand of improving the quality of the galvanized steel sheet itself.

SUMMARY OF THE INVENTION

It is, therefore, an object of the invention to improve the resistance to hot-dip galvanization and resistance to thermal shock in the spray coating for the plating bath member.

The inventors have made various studies and found that when the spray-coating film of non-oxide ceramic is immersed in a hot-dip galvanization bath containing Al, Al is selectively concentrated in the vicinity of the surface layer of the ceramic coating film to form a high concentration Al—Zn alloy layer or an Al—Zn alloy layer containing a metal component in the spray coating film. Futher, it has been found that when such a high concentration Al—Zn alloy layer is formed, the diffusion rate of zinc from the galvanization bath into the inside of the coating film is extremely lowered.

Under the above circumstance, the inventors have considered that the coating film having excellent resistance to hot-dip galvanization will be obtained by previously forming the high concentration Al layer onto the spray coating film and found that after the formation of non-oxide ceramic coating film, the high concentration Al layer is formed on the surface of the coating film by (i) a method wherein Al or Al—Zn alloy is coated by spraying or vapor deposition process and diffused by heating, (ii) a method wherein Al powder or a powder consisting essentially of Al—Zn alloy is diffused by heating, (iii) a method wherein the film is immersed in high concentration Al—Zn molten alloy for a certain time, and the like to form a so-called composite structure of the film having excellent resistance to hot-dip galvanization.

The invention lies in a composite spray coating obtained by diffusing Al or Al—Zn alloy into the surface of a film spray-coated on an iron base material, such as a non-oxide ceramic, a cermet consisting essentially of non-oxide ceramic and containing a metal or the like. That is, the diffusion layer of Al or Al—Zn alloy is formed on the spray coating film of the cermet containing a carbide, a boride or a mixture thereof by the following methods:

(1) Al or Al—Zn alloy is sprayed onto a coating film of a non-oxide ceramic or a cermet of the ceramic and metal and then heated at a high temperature, e.g. 700°–900° C., to diffuse Al or Al—Zn alloy into the inside of the film;

(2) the coating film of the non-oxide ceramic or the cermet thereof is immersed in a zinc plating bath containing Al (e.g. 5%) for about 2–3 days to concentrate Al into the film surface, which is used in an original zinc plating bath (usually containing 0.1– 0.3% of Al); and (3) the coating film of non-oxide ceramic or the cermet thereof is embedded in powder consisting essentially of Al powder (e.g. 60% by weight of Al powder and 40% by weight of powder) or powder consisting essentially of Al—Zn alloy powder (e.g. 60% by weight of 50% Al-50% Zn alloy, 38% by weight of $Al_2O_3$ and 2% by weight of $NH_4Cl$) and then heated at 500°–800° C. in an argon gas atmosphere for several hours.

According to these methods, the diffusion layer of Al or Al—Zn alloy and non-diffusion layer composed only of Al are formed in the vicinity of the surface layer of the spray coating of non-oxide ceramic or the like. Particularly, a great amount of Zn adhered layer is formed together with the diffusion layer high concentration Al—Zn alloy by the method (2). Moreover, the undiffused Al layer and Zn adhered layer may be mechanically removed, but even when they are used in the hot-dip galvanization bath as they are, Al and Zn components existent on the surface immediately diffuse into the bath so that there is caused no trouble in the plating operation.

When the Al diffusion layer formed in the composite spray coating is immersed in the hot-dip galvanization bath, it rapidly changes into high concentration Al—Zn alloy layer through penetration of zinc. The resulting Al—Zn alloy layer always existent as a solid phase state because its melting point is higher than an operation temperature of hot-dip galvanization (usually 460°–490° C.), and acts to extremely delay subsequent zinc diffusion rate. Furthermore, when the Al—Zn alloy diffusion layer or the Al—Zn alloy layer containing the metal component in the composite spray coating is immersed in the hot-dip galvanization bath, it is always existent at solid phase state while maintaining the state of high concentration Al—Zn alloy layer and acts to delay subsequent zinc diffusion rate.

According to the inventors' knowledge, when the spray coating film of WC (88 wt %)-Co (12 wt %) having a thickness of 100 μm is immersed in pure zinc at 480° C., zinc passes through the coating in about 10 days, but when the Al diffusion layer having an Al concentration of 10–20 wt % is formed on the surface of the coating film, the time passing through the coating is 130–150 days, while the Al diffusion layer having an Al concentration of 30–40% is formed, the passing time exceeds 1000 days.

The diffusion of hot-dip zinc into the composite spray coating according to the invention is conducted mainly by penetrating hot-dip zinc through particle boundaries of laminated particles formed by spraying while dissolving the metal component (Co in this case) constituting the spray coating, and in this case, when Al (previously diffused) is existent in the penetrating passage, molten zinc is easily alloyed with Al. This Al—Zn alloy obstructs the penetration of zinc to considerably delay the penetration rate. Moreover, the non-oxide particles themselves have a strong resistance force to hot-dip zinc and are not eroded.

Furthermore, the composite spray coating of the non-oxide ceramic diffused with Al or Al—Zn alloy is excellent in the toughness, so that it is strong to thermal shock in the immersion in or taking out from the hot-dip galvanization bath and improves the phenomenon of causing the local peeling inherent to the spray coating.

The coating material used in the composite spray coating according to the invention is preferably non-oxide series ceramics, which includes carbides such as $Cr_3C_2$, TiC, ZrC, WC, $WTiC_2$, $B_4C$, NbC and the like; and borides such as $CrB_2$, $TiB_2$, $ZrB_2$ and the like.

Further, cermet is effective as the coating material used in the invention, which is, for example, a mixture of the above carbide or boride and at least one metal of Co, Ni, Cr and the like.

In order to form the coating film according to the invention onto a surface of a sink roll for the plating bath made from an iron base material such as steel or the like, preferable spraying methods include utilizing combustion or explosion energy of oxygen-hydrogen, oxygen-hydrocarbon or the like; or a spraying method of using gas plasma of Ar, $H_2$, $N_2$, He or the like as a heat source, as well as other spraying methods.

According to the invention, the diffusion of Al is carried out on the spray coating film applied to the surface of the sink roll as mentioned above. In this case, the purity of Al is not particularly restricted. That is, the Al diffusion layer aimed at the invention may be obtained by using aluminum alloys such as Al—Ni, Al—Si, Al—Fe, Al—Ti or the like.

Figure 1:
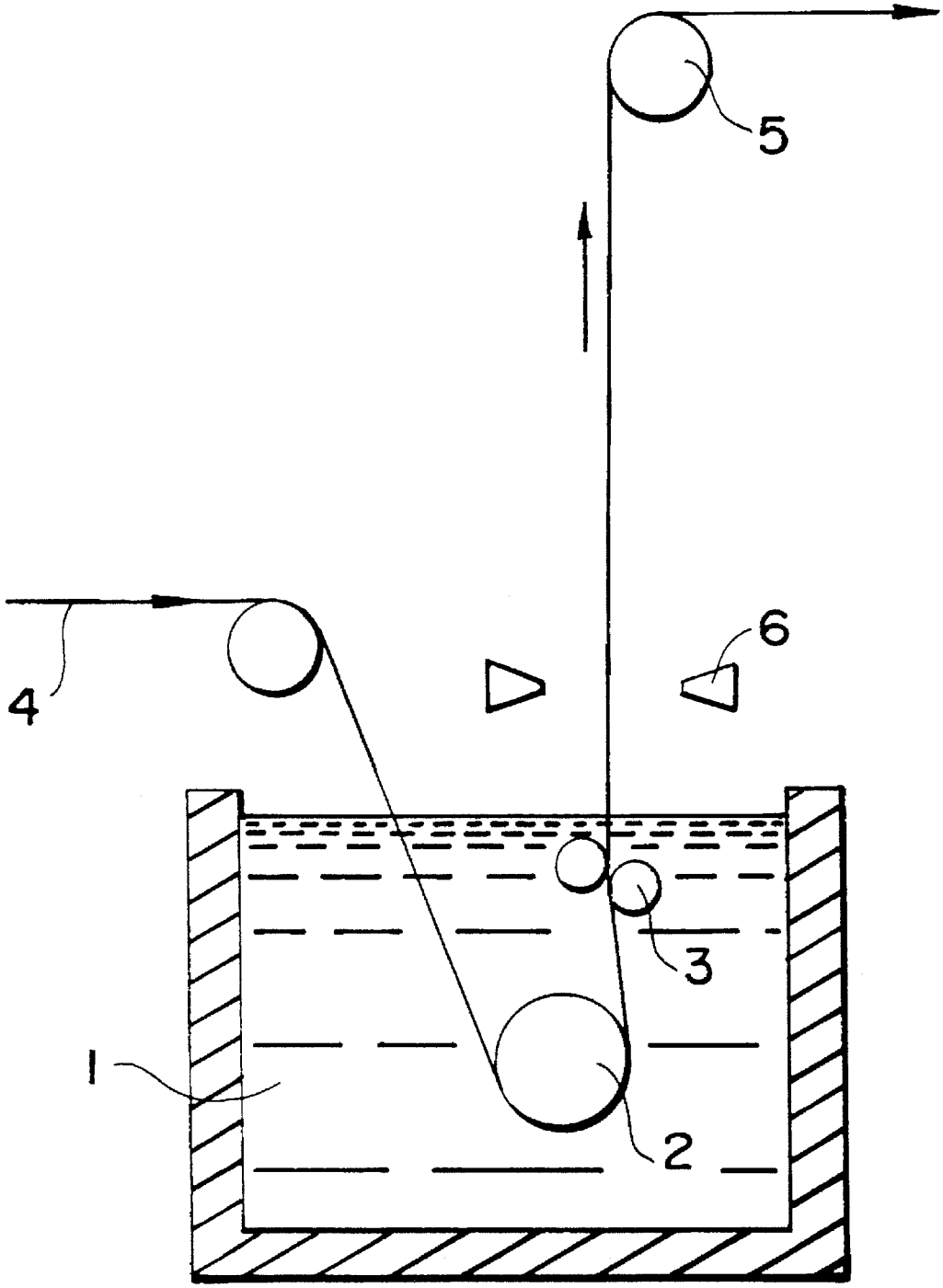
FIG. 1 is a schematic of a hot dip galvanization apparatus.

The following examples are given in illustration of the invention and are not intended as limitations thereof.

Example 1

In order to examine the resistance to hot-dip galvanization in the composite spray coating according to the invention, the change of appearance in the coating and the penetration depth of zinc into the coating were tested by forming the coating film of 100 μm in thickness on the surface of soft steel specimen (diameter 15 mm×length 200 mm) and immersing in a hot-dip galvanization bath at 480° C. and then taking out therefrom. For the comparison, the test was conducted by using a simple coating film, a self-fluxing alloy coating (JIS 8303, MSFCo 1) and a $Al_2O_3$ coating at a thickness of 100 μm. The composition of each test coating was as follows. Moreover, numerical value in parenthesis was weight %.

(1) WC (88)-Co (12)

(2) WC (83)-Co (17)

(3) $WTiC_2$ (85)-Ni (10)-Co (5)

(4) WC (63)-CraCz (20)-Co (17)

(5) $Cr_3C_2$ (75)-Ni (20)-Cr (5)

The test Was conducted after the coating film having each of the above compostions (1)–(5) was formed and subjected to a diffusion treatment of Al by the following method.

(i) Al coating of 30 μm in thickness was formed on the above spray coating film and then heated at 750° C. in an argon gas atmosphere for 2 hours (which was called as an Al diffusion process);

(ii) The coating film was immersed in a hot-dip galvanization bath (490° C.) containing 5% of Al for 3 days and then taken out therefrom (which was called as an immersion process); and (iii) The coating film was embedded in Al powder and then heated at 700° C. in an argon gas atmosphere for 2 hours (which was called as a pack process).

The test results are shown in Table 1. In the self-fluxing alloy coating of the comparative example (No. 11), the base material was locally exposed by erosion of hot-dip zinc and then the reaction product between the component of the base material and zinc (Fe—Zn alloy) was formed and zinc was adhered thereon to form a lump. In case of $Al_2O_3$ coating (No. 12), hot-dip zinc was completely passed to locally break the coating. Further, in the spray coatings of carbide cermet (No. 6– No. 10), the breakage due to erosion of hot-dip zinc was not observed, but zinc completely passed through the coating to arrive at the surface of the base material.

On the contrary, in case of the composite spray coatings according to the invention, the penetration depth of zinc was only about 10 μm from the surface, and there was observed no abnormal state in the appearance and the coating was sound.

TABLE 1

| | No. | Composition of spray coating (wt %) | Penetration depth of Zinc (μm) Al diffusion process | Al immersion process | Al pack process | Appearance of coating |
|---|---|---|---|---|---|---|
| Acceptable Example | 1 | WC(88)—Co(12) | ≦5 | ≦5 | ≦5 | No trouble |
| | 2 | WC(83)-Cp(17) | ≦5 | ≦5 | ≦5 | No trouble |
| | 3 | WTiC(85)—Ni(10)—Co(5) | ≦8 | ≦7 | ≦6 | No trouble |
| | 4 | WC(63)—$Cr_3C_2$(20)—Co(177) | ≦8 | ≦8 | ≦8 | No trouble |
| | 5 | $Cr_3C_2$(75)—Ni(20)—Cr(5) | ≦8 | ≦9 | ≦8 | No trouble |
| Comparative Example | 6 | WC(88)—Co(12) | pass through coating | | | No trouble |
| | 7 | WC(83)—Co(17) | pass through coating | | | No trouble |
| | 8 | WTiC(85)—Ni(10)—Co(5) | pass through coating | | | No trouble |
| | 9 | WC(63)—$Cr_3C_2$(20)—Co(17) | pass through coating | | | No trouble |
| | 10 | $Cr_3C_2$(75)—Ni(20)—Cr(5) | pass through coating | | | No trouble |
| | 11 | self-fluxing alloy (MSFCo 1) | pass through coating | | | local breakage |
| | 12 | $Al_2O_3$(100) | pass through coating | | | local breakage |

Example 2

The same spray coating film as in Example 1 was immersed in a hot-dip galvanization bath held at 480° C. for 1 hour, and then taken out therefrom and compressed air was blown onto the surface of the coating film to cool up to room temperature (25° C.). After the above procedure was repeated 20 times, the appearance of the coating film, particularly a peeled state thereof as well as the resistance to thermal shock were measured to obtain the results as shown in Table 2.

TABLE 2

| | No. | Composition of spray coating (wt %) | Peeling area of coating (%) Al diffusion process | Al immersion process | Al pack process |
|---|---|---|---|---|---|
| Acceptable Example | 1 | WC(88)—Co(12) | 0 | 0 | 0 |
| | 2 | WC(83)-Cp(17) | 0 | 0 | 0 |
| | 3 | WTiC(85) —Ni(10)—Co(5) | 0.1 | 0 | 0.1 |
| | 4 | WC(63)—$Cr_3C_2$(20)—Co(17) | 0.1 | 0 | 0.1 |
| | 5 | $Cr_3C_2$(75)—Ni(20)—Cr(5) | 0.1 | 0.1 | 0.1 |
| Comparative Ex-le ample | 6 | WC(88)—Co(12) | | 5.2 | |
| | 7 | WC(83)—Co(17) | | 4.3 | |
| | 8 | WTiC(85)—Ni(10)—Co(5) | | 6.8 | |
| | 9 | WC(63)—$Cr_3C_2$(20)—Co(17) | | 7.9 | |
| | 10 | $Cr_3C_2$(75)—Ni(20)—Cr(5) | | 7.3 | |
| | 11 | self-fluxing alloy (MSFCo 1) | | 3.0 | |
| | 12 | $Al_2O_3$(100) | | 32.3 | |

In the coating films (No. 6–No. 12) as a comparative example, the coating was locally and frequently peeled off of the base material by thermal shock. Particularly, the peeled state of $Al_2O_3$ (No. 12) was 32% of the whole, while the peeled state of 4.0–7.9% was observed even in the carbide cermet coatings (No. 6–No. 10). These coatings demonstrate the properties of standard coating film, i.e., that the resistance to hot-pit galvanization was excellent but the adhesion property to the base material was poor. In the self-fluxing alloy coating (No. 11), the peeled state was only 3%, but when the coating film was taken out from the hot-dip galvanization bath, a great amount of zinc adhered to the surface of the film by an alloying reaction with the component of the film to merely suppress the peeling of the coating film, which showed that such a coating film was unsuitable as a coating for hot-dip galvanization requiring the cleaned surface.

On the contrary, in the composite spray coating films according to the invention, the adhesion property to the base material was improved by diffusing Al into the carbide cermet coating and hence the good surface state was obtained without substantially causing the peeling, and also the resistance to thermal shock was excellent.

Example 3

Each of $CrB_2$, $ZrB_2$, $TiB_2$ and $Cr_3C_2$ having a thickness of 100 μm was applied to a soft steel specimen (diameter 15 mm×length 200 mm) by plasma spraying in an argon gas atmosphere of 100–200 mbar, and thereafter Al was diffused thereinto by (i) Al diffusion process, (ii) Al immersion process, or (iii) Al pack process, which was immersed in a hot-dip galvanization bath at 480° C. for 20 days. After the specimen was taken out of the bath, the resistance to hot-dip galvanization of the resulting composite coating film was measured by the same method as in Example 1. For the comparison, there were used spray coatings of $CrB_2$, $ZrB_2$, $TiB_2$ and $Cr_3C_2$ each not diffusing Al. The measured results are shown in Table 3.

TABLE 3

| | No. | Composition of spray coating (wt %) | Penetration depth of Zinc (μm) Al diffusion process | Al immersion process | Al pack process | Appearance of coating |
|---|---|---|---|---|---|---|
| Acceptable Example | 1 | $CrB_2$(100) | ≦4 | ≦5 | ≦3 | No trouble |
| | 2 | $ZrB_2$(100) | ≦5 | ≦5 | ≦4 | No trouble |
| | 3 | $TiB_2$(100) | ≦3 | ≦4 | ≦4 | No trouble |
| | 4 | $Cr_3C_2$(100) | ≦4 | ≦5 | ≦5 | No trouble |
| Comparative Example | 1 | $CrB_2$(100) | locally pass through coating | | | local peeling |
| | 2 | $ZrB_2$(100) | locally pass through coating | | | local peeling |
| | 3 | $TiB_2$(100) | locally pass through coating | | | local peeling |
| | 4 | $Cr_3C_2$(100) | locally pass through coating | | | local peeling |

Even in the $CrB_2$, $ZrB_2$, $TiB_2$ and $Cr_3C_2$ coatings as a comparative example (NO. 6–No. 10), good resistance to hot-dip galvanization is obtained, but the local peeling of the film is frequently observed due to the penetration of zinc from defects of the film (throughholes).

On the contrary, the composite coatings according to the invention have less penetration of zinc and maintain good surface state without changing the appearance of the coating.

aluminum (including 39 wt % of $Al_2O_3$ and 1 wt % of $NH_4Cl$ as other component), to and heated by the pack process at 630° C. in an argon gas atmosphere, for 2 hours, to form Al—Zn alloy diffusion layer on the surface of the spray coating specimen.

After the specimen was immersed in a hot-dip galvanization bath containing 0.1% by weight of Al (480° C.) for 30 days and taken out therefrom, the appearance of the specimen was observed to evaluate the resistance to hot-dip valcanization. At the same time, the coating specimen of the comparative example was measured in the same manner as in Example 1. The measured results are shown in Table 4.

TABLE 4

| | No. | Composition of spray coating | Al content in Al—Zn alloy powder (wt %) | Appearance of coating |
|---|---|---|---|---|
| Acceptable Example | 1 | WC(88)—Co(12) | 5 | coating is sound, but adhession of Zinc is large |
| | 2 | | 10 | Smooth, no trouble |
| | 3 | | 20 | Smooth, no trouble |
| | 4 | | 40 | Smooth, no trouble |
| | 5 | | 60 | Smooth, no trouble |
| | 6 | | 80 | Smooth, no trouble |
| | 7 | | 95 | Smooth, no trouble |
| Comparative Example | 8 | WC(88)—Co(12) | — | occurrance of light peeling |
| | 9 | WC(83)—Co(17) | — | occurrance of light peeling |
| | 10 | WTiC(85)—Ni(1)—Co(5) | — | local coating breaklage |
| | 11 | WC(63)—$Cr_3C_2$(20)—Co(17) | — | local coating breaklage |
| | 12 | $Cr_3C_2$(75)—Ni(20)—Cr(5) | — | local coating breaklage |
| | 13 | self-fluxing alloy (MSF Co 1) | — | local disappear of coating |
| | 14 | $Al_2O_3$(100) | — | large coating peeling |

Example 4

A material of WC (88)-Co (12) having a thickness of 200 μm was sprayed onto a soft steel specimen (diameter15× length 200 mm) to form a spray coated specimen, which was embedded in Al—Zn alloy powder containing 5–95 wt % of In the self-fluxing alloy of the comparative example (No. 13), the base material was locally exposed by violent errosion of zinc and the reaction product between base component and zinc (Fe—Zn alloy) was grown thereon to adhere a great amount of zinc to the specimen, so that the self-fluxing alloy film could not directly be observed. When the specimen was cut and its cut section was observed, the spray coating was locally and completely lost, where the base material itself was deeply erroded. Further, the $Al_2O_3$ coating (No. 14) was completely lost, while fine local breakage due to the errosion of hot-dip zinc was observed even in the carbide cermet coatings (No. 8–12).

On the contrary, in the composite spray coatings according to the invention, the adhesion of zinc was observed, but the coating itself was maintained in a sound state. Particularly, the appearance of the coatings containing Al larger than Al (10)-Zn (90) alloy was very smooth. From these results, it was apparent that the alloy having an Al content of not less than 10% was suitable as Al—Zn alloy.

Example 5

A coating of WC (88)-Co (12) having a thickness of 150 μm was formed on a sink roll, (material JIS G3445(1983) STKM13A) in a continuous hot-dip galvanization apparatus shown in FIG. 1 (1: hot-dip galvanization bath, 2: sink roll, 3: support roll, 4: steel sheet to be plated, 5: guide roll, 6: spray nozzle), by a high speed gas flame spraying process, and thereafter (i) Al pack process or (ii) Al immersion process was conducted to form a composite spray coating according to the invention.

Then, the sink roll provided with the composite spray coating according to the invention was used in a hot-dip galvanization bath containing 0.11% of Al at 480° C. for 2 months for the continuous production of hot-dip galvanized steel sheet. As a result, the sink roll provided with the composite spray coating according to the invention did not badly affect the quality of the galvanized steel sheet and was durable in a long continuous operation, and also the coating itself was sound. Furthermore, the adhesion of dross (Fe—Zn, Fe—Al, Fe—Al—Zn alloys) suspended at a state of fine solid particle in the hot-dip galvanization bath was very small.

On the other hand, the conventional WC (88)-Co (12) spray coating was durable to continuous operation of about 1 month, but there were observed local peeling of the coating and the erosion of hot-dip zinc into the base material in the peeled portion. From this fact, it has been confirmed that the composite spray coating according to the invention is preferential as compared with the conventional spray coating.

As mentioned above, the composite spray coating according to the invention is formed by diffusing Al into the surface of the cermet spray coating of carbide, boride or the like through diffusion process, immersion process in molten metal or the like, and develops excellent resistance to hot-dip galvanization and resistance to thermal shock in hot-dip galvanization. As a result, it is possible to conduct operation of conducting hot-dip galvanized steel sheet for a long time, and also the reduction of maintenance cost for equipment and therefore production cost can be expected. Furthermore, the elution of roll component into hot-dip galvanization bath can be prevented by the protective action of the coating against the roll material to prevent the contamination of molten metal, so that the galvanized steel sheet having a quality can be produced.

What is claimed is:

1. A method of producing a composite spray coating having improved resistance to hot-dip galvanization, comprising:

spraying a non-oxide ceramic or a cermet of ceramic and metal onto a material forming a layer having a surface; and diffusing aluminum or aluminum alloy into the surface of the layer.

2. The method of producing a composite spray coating as defined in claim 1, wherein aluminum or aluminum alloy is diffused into the surface of the layer by spraying aluminum or aluminum alloy onto the surface; and heating the sprayed surface at 700°– 900° C.

3. The method of producing a composite spray coating as defined in claim 1, wherein aluminum or aluminum alloy is diffused into the surface of the layer by immersing the layer into a zinc plating bath, wherein the zinc plating bath contains about 5% aluminum; and removing the layer from the bath.

4. The method of producing a composite spray coating as defined in claim 3, wherein the layer is removed from the bath in 2 to 3 days.

5. The method of producing a composite spray coating as defined in claim 1, wherein aluminum or aluminum alloy is diffused into the surface of the layer by embedding the layer in powder comprising aluminum powder or aluminum-zinc alloy powder; and heating the embedded layer at 500°–800° C.

6. The method of producing a composite spray coating as defined in claim 5, wherein the powder consists essentially of aluminum powder or aluminum-zinc alloy powder.

7. The method of producing a composite spray coating as defined in claim 1, wherein the aluminum or aluminum alloy is selected from the group consisting of Al—Zn, Al—Ni, Al—Si, Al—Fe and Al—Ti.

8. The method of producing a composite spray coating as defined in claim 7, wherein said aluminum alloy comprises an aluminum-zinc alloy.

9. The method of producing a composite spray coating as defined in claim 8, wherein said aluminum-zinc alloy contains not less than 10% by weight of aluminum.

10. The method of producing a composite spray coating as defined in claim 1, wherein said material comprises an iron base material.

11. A composite spray coating having improved resistance to hot-dip galvanization produced by the process of claim 1.

12. A composite spray coating having improved resistance to hot-dip galvanization produced by the process of claim 2.

13. A composite spray coating having improved resistance to hot-dip galvanization produced by the process of claim 3.

14. A composite spray coating having improved resistance to hot-dip galvanization produced by the process of claim 5.

15. A composite spray coating having improved resistance to hot-dip galvanization produced by the process of claim 9.

16. A composite spray coating having improved resistance to hot-dip galvanization produced by the process of claim 10.

* * * * *